US005735683A

United States Patent [19]

Muschelknautz

[11] Patent Number: 5,735,683

[45] Date of Patent: Apr. 7, 1998

[54] INJECTOR FOR INJECTING AIR INTO THE COMBUSTION CHAMBER OF A TORCH BURNER AND A TORCH BURNER

[75] Inventor: Edgar Muschelknautz, Stuttgart, Germany

[73] Assignee: E.E.T. Umwelt - & Gastechnik GmbH, Germany

[21] Appl. No.: 449,136

[22] Filed: May 24, 1995

[30] Foreign Application Priority Data

May 24, 1994 [DE] Germany ..... 44 18 014.4

[51] Int. Cl.[6] ..... F23G 7/06; F23L 7/00

[52] U.S. Cl. ..... 431/202; 431/353; 239/419.5

[58] Field of Search ..... 431/202, 350, 431/354, 353; 239/DIG. 7, 400, 404, 406, 419.5; 60/737, 740, 743

[56] References Cited

U.S. PATENT DOCUMENTS

| | | | |
|---|---|---|---|
| 794,545 | 7/1905 | Phillips, Jr. | 431/354 |
| 799,424 | 9/1905 | Welch | 431/354 |
| 1,440,614 | 1/1923 | Mettler | 239/430 |
| 1,968,395 | 7/1934 | Henson | 431/353 |
| 2,075,867 | 4/1937 | Sampel | 239/430 |
| 2,222,822 | 11/1940 | Nordensson | 431/353 |
| 2,974,488 | 3/1961 | Eggers et al. | 60/749 |
| 3,017,920 | 1/1962 | Blockley et al. | 431/353 |
| 3,044,537 | 7/1962 | Keating et al. | 431/354 |
| 3,497,308 | 2/1970 | Flynn | 431/202 |
| 3,885,891 | 5/1975 | Throndson . | |
| 3,963,443 | 6/1976 | Bond et al. | 431/353 |
| 4,033,714 | 7/1977 | Longworth | 431/354 |
| 4,253,610 | 3/1981 | Larkin | 239/430 |
| 4,718,178 | 1/1988 | Wipple | 239/DIG. 7 |

FOREIGN PATENT DOCUMENTS

| | | |
|---|---|---|
| 0 042 743 | 12/1981 | European Pat. Off. . |
| 24 22 785 | 1/1975 | Germany . |

OTHER PUBLICATIONS

Patent Abstracts of Japan, vol. 106, No. 181 (M-1242), Apr. 30, 1992 & JP-A-04 019400 (Hisamoto Suzuki), Jan. 23, 1992, Abstract.

Cuhna-Leite, Olavo, "Design alternative, components key to optimum flares" in: *Oil & Gas Journal*, vol. 90, No. 47, Nov. 23, 1992, pp. 70-74, 76.

*Primary Examiner*—Carl D. Price

*Attorney, Agent, or Firm*—Townsend and Townsend and Crew LLP

[57] ABSTRACT

An injector (12) for sucking in environmental air and for injection into the combustion chamber (12) of a torch burner (11) by means of a driving fluid (14) standing under excess pressure, has an air induction opening (15), a flow channel (16) and injection openings (17) through which the driving fluid (14) is blown into a mixing region (19) where it mixes with induced air. The flow channel (16) has a diffusor region (18) ajoining the mixing region (19) in the flow direction and has an outlet opening (20) for the mixture of air and driving fluid. In accordance with the invention, injection openings (17) open into a dead flow space (22) from which spray jets (23) are directed into the mixing region (19).

18 Claims, 8 Drawing Sheets

Fig. 8a
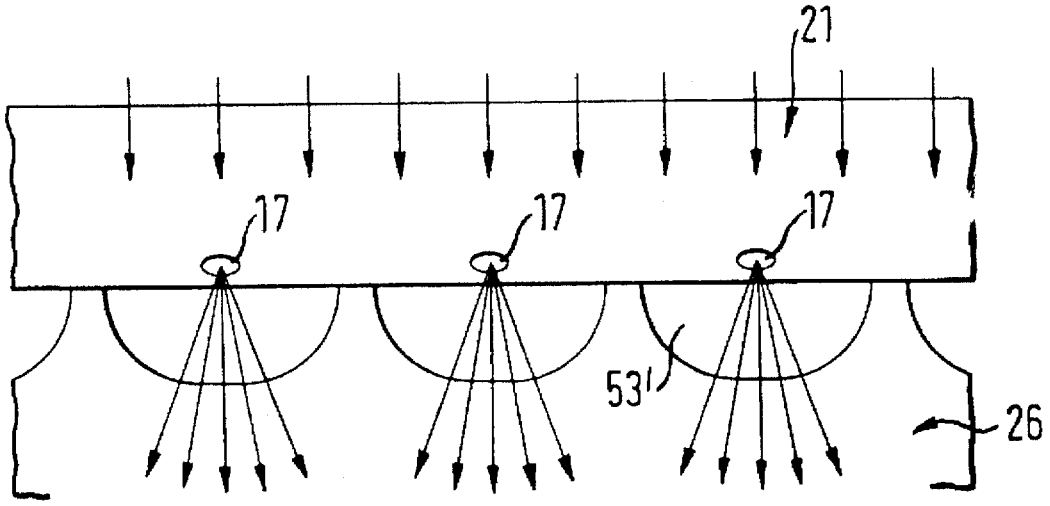
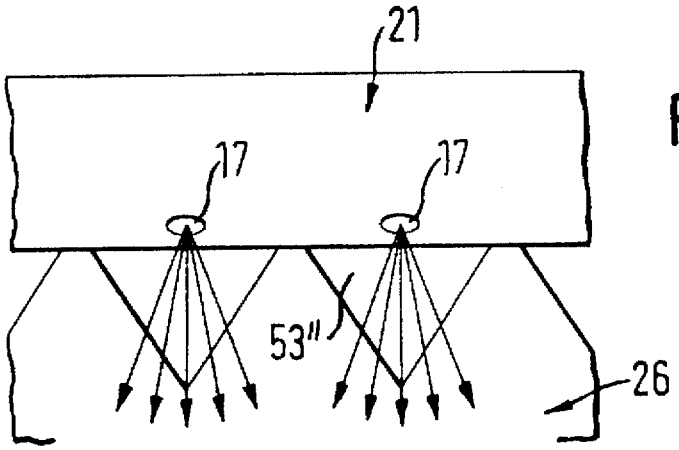
Fig. 8b
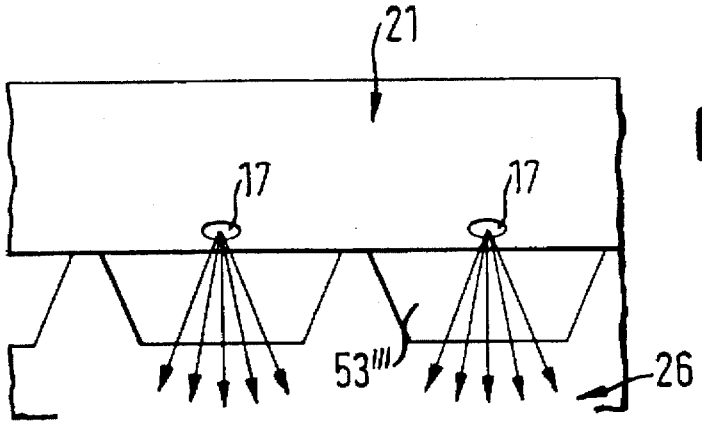
Fig. 8c

INJECTOR FOR INJECTING AIR INTO THE COMBUSTION CHAMBER OF A TORCH BURNER AND A TORCH BURNER

The invention relates to an injector, in particular for the induction of environmental air and injection into the combustion chamber of a torch burner having an inlet, an outlet, and a combustion chamber between the inlet and outlet. The chamber has a group of injectors, injecting ambient air and driving fluid into the interior of the combustion chamber.

BACKGROUND OF THE INVENTION

It is already known to mix environmental air and a driving fluid in a mixing path of a tubular duct section which is, as a rule, straight, by sucking in or inducing a flow of the environmental air with the driving fluid which flows at a substantially higher speed and for the mixing to take place along the mixing path.

SUMMARY OF THE INVENTION

The invention relates to injectors used in combination with torch burners. The torch burner has an inlet, an outlet, and a combustion chamber between the inlet and the outlet. The chamber is defined by a wall, and it is through this wall that a series of injectors inject driving fluid and ambient air. The disclosed injectors each have an air induction opening outside of the combustion chamber for receiving ambient air. The air induction openings define an air flow channel from the air induction opening. This air flow channel ultimately discharges through the wall of the combustion chamber into the combustion chamber. The air flow channel has a driving fluid mixing region and a diffuser region, the diffuser region being immediately before discharge into the combustion chamber.

In a preferred embodiment, the driving fluid mixing region defines a constricting passage from the air induction opening to and towards the driving fluid mixing region. A driving fluid manifold is positioned about the air induction opening, and has an inlet for receiving driving fluid and a plurality of outlets discharging into the mixing region. These outlets intermix the driving fluid and ambient air to produce a discharge into the combustion chamber. In the preferred embodiment, the driving fluid manifold defines a dead flow space between the air induction opening and the driving fluid mixing region to produce optimized driving fluid mixing with introduced ambient air.

The object of the present invention is to provide an injector and a torch burner of the initially named kind in which the conveying and mixing performance is optimized with comparatively large volume flows of the air and comparatively small volume flows of the driving fluid by reducing as far as possible the wall friction in the mixing region and achieving an almost complete momentum transfer from the driving fluid to the induced air. In other words, the invention aims at achieving an ideal and rapid through-mixing of the air and the driving fluid over the shortest possible path, with a momentum transfer from the driving fluid to the air which is as free from losses as possible.

In order to satisfy this object, a torch burner having an inlet, an outlet, and a combustion chamber therebetween are provided. This torch burner is provided with a series of injectors, which inject ambient air and ambient air-driving fluid into the combustion chamber. A driving fluid manifold discharges driving fluid into a dead flow space behind a manifold. This provides optimum mixing of the driving flow with ambient air for injection into the combustion chamber.

The outlet of the air flow can diverge from the channel walls at angles from 5° to 20°. Moreover, and to define the dead space, each of the outlets of the plurality of outlets is spaced from the flow-channel wall a distance larger than the opening of the outlets introducing the driving fluid. Particularly advantageous further developments can be found from claims 2 and 3.

The important concept underlying the invention is thus that the extent of the dead flow space (or stagnation space) in the region of the injection openings, in particular between the injection openings and the flow channel wall, is greater than the cross-section of the injection openings.

A constructionally particularly preferred embodiment which, moreover, leads to a particularly short constructional length with ideal mixing performance in one of the embodiments, a driving fluid manifold for introducing the driving fluid constitutes a ring tube. This ring tube fits to the entrance of an air flow channel, having a driving fluid mixing region and a diffuser region which discharges into the combustion chamber.

Thus, in accordance with the invention, a considerable reduction of the frictional losses of the induced environmental air is achieved in that the mouth of the inlet is rounded and in this manner flow separations are extensively avoided. The dead flow spaces in accordance with the invention have the advantage that the spray jets trigger a return flow there in the wall region, so that an intensive mixing of the driving fluid with the inflowing air takes place around each individual spray jet. The air throughput and the mixing intensity apertures can be placed in the wall of the air flow channel in the mixing region for introducing ambient air through the air flow channel.

The arrangement of the injection openings for the driving fluid in a screened dead flow space also reduces the outward sound radiation in advantageous manner.

The embodiment includes the use of a ring tube manifold for discharging driving air, the ring tube being constructed from at least four straight circular cross-sectioned tubes to form a rectangular or polygonal air induction opening through the center of the ring tube. This has the advantage that the induction cross-section is enlarged through the corner regions of the polygon and thus the throughput of environmental air is increased. At least one injection opening should be provided in the region of the center of each tube section because this is the position of closest proximity to the center of the environmental air flow. In this way, the homogenous action of the driving fluid on the air and the homogenous mixing of the driving fluid with the air are substantially favored.

Cylindrical bores serve as the injection openings for the driving fluid from the ring tube in the simplest case and in a particularly advantageous manner construction-wise. Inserted nozzles can increase the efficiency of the spray jets. By using Laval nozzles, a maximum conversion of pressure energy of the driving fluid into the energy of movement of the spray jets is achieved which serves for the conveyance of the air. With the arrangement of the injection openings in several planes, an improvement of the homogenous mixture and momentum transfer of the spray jets to the air is achieved. Accordingly, a second ring tube could be arranged on the ring tube of the invention, whereby two axially spaced rings of injection openings for the driving fluid could likewise be made available. In particular, with several planes of injection openings arranged above one another, the direction of the axes of the injection openings can deviate from the perpendicular to the tangent at the cross-section of the ring tube at the location of the relevant injection opening more in the direction towards the wall, so that the spray jets do not include too large an angle with the central axis.

Through the most extensive avoidance of wall contact a minimization of the wall friction of the spray jets generated by the driving fluid can be achieved. In particularly advantageous manner, air can be sucked in in the region where the wall contact of the spray jets is avoided in the sense of a return flow essentially contrary to the main flow direction and can be picked up by the driving fluid from the wall side.

The ring tube is preferably mounted onto the mixing region of the flow channel. In this way, not only does an ideal through-mixing take place on a short path, but, rather, also an unhindered low loss induction or sucking in of the air is made possible from a large part of the surroundings. It is, however, preferred when the walls of the mixing region, which preferably extend parallel to the main flow direction, intersect at an angle of 90° to the tangents to the cross-section of the ring tube at the point of contact of the wall and the ring tube.

In the mixing region, there should be neither a flow speed increase due to convergence of the flow channel nor a flow speed reduction due to divergence of the flow channel. In this way, an ideal and particularly low loss mixing effect is achieved.

To increase the throughput of air with a constant throughput of the driving fluid, a diffusor region inserted after the mixing region proves to be advantageous. In this way, the depression in the mixing region is increased and the lack of sensitivity to pressure fluctuations of the air is increased. With an arrangement with a following diffusor ratios of the throughput of environmental air to driving fluid between 10 and 25 are possible.

Of particular advantage is, furthermore, the subdivision of the diffusor region into at least two sections with the aid of sheet metal vanes arranged in the flow direction, since in this way the flow retarding and pressure building action of the diffusor region is improved, and, in particular, the angle of divergence of the diffusor can be increased and the diffusor length decreased.

Utilizing the disclosed injectors, the through-flow ratio environmental air to driving fluid lies in the range between 10 and 25.

Of particular advantage is the use of the invention in a torch burner having an inlet, an outlet, and a wall defining a combustion chamber between the inlet and outlet. In this application, the sensitivity of the torch burner to side winds is substantially reduced. Furthermore, low weight and small dimensions of the injector of the invention facilitate the installation and reduce the wind forces and weight forces which are acting in the region of the combustion chamber arranged at a large height at the end of the chimney-like extraction tube. The actual combustion, however, only takes place in the combustion chamber at minimum load, whereas during the flaring off of larger quantities of flare gas, an extensive mixing of the flare gas and of the air/driving fluid mixture only occurs when the combustion takes place above the outlet opening. A wind shield can improve further the lack of sensitivity to side winds, particularly in the partial load region. Through optimized induction of the air from the environment the throughflow is also improved when very many injectors are arranged together in the smallest space. The noise emission of the torch burner is substantially reduced through the low noise design of the injectors. Moreover, the completeness of combustion is promoted and thus the formation of soot is reduced.

Various configurations of the torch burner are discussed. For example, the injectors can be uniformly distributed around the periphery of the combustion chamber in a horizontal plane. Alternately, they can be distributed around several vertically-spaced horizontal planes. These injectors can be perpendicular to the wall defining the combustion chamber, and can have an angle up to 30° with respect to a central access taken through the combustion chamber. Furthermore, the injectors can provide a helical component of flow to gases within the combustion chamber, or provide alternating directions of flow with the eventual discharge having no overall component of twist. With this design, it is possible to match the flow of driving fluid in injected ambient air to optimize in accordance with disclosed combustion equations the combustion that occurs within the combustion chamber. It is also disclosed that either saturated or super-heated steam in the range from 130° C. to 300° C., and in the pressure range from 2 bars to 30 bars, may be used.

Advantageous is, in particular, the use of water vapor as a driving fluid because it is, for example, in any event available in ethylene plants and also has a certain influence on the soot suppression process via the hydrogen reaction. Through the displaced arrangement of the injectors, the mixing jets emerging from them into the combustion space act as a blocking grid for the torch gas supplied through the chimney tube. They thus promote mixing and an improvement of the combustion processes takes place with respect to freedom from soot and full combustion.

The injectors of the invention could basically be arranged in the cylindrical part of the torch burner. Preferred is, however, their arrangement in a combustion space which diverges conically and which is provided at the top on the chimney tube.

When the injectors are arranged at least perpendicular to the jacket surface of the conical combustion chamber, and are directed upwardly at an angle of up to 30° to the central axis of the combustion space, then this contributes to the improvement of the homogenous mixing of combustion air into the torch gas with a suitable adjustment of the injector angle.

The imparting of twist, by having the injectors inclined with respect to the axis of the combustion chamber, improves the combustion, in that cold torch gas layers in the centrifugal field are carried outwardly into the edge zone, as a result of their higher density, where they come into intensive contact with the combustion air supplied there. With alternate twist per periphery provided with injectors, homogenous mixing of the combustion air with the torch gas is further favored.

BRIEF DESCRIPTION OF THE DRAWINGS

The invention will be described in the following with reference to the drawings in which are shown:

FIGS. 8*a*, 8*b*, and 8*c* are various further embodiments for the design and arrangement of the additional air induction openings.

FIG. 9 shows the upper end of a torch burner or flare 11 having a extraction tube or chimney 32 which is vertically arranged outdoors and which has a vertical central axis 34 through which flare gas flows upwardly in the direction of the arrow 38. In the upper end region of the chimney tube 32 there is an upwardly divergent, truncated cone-shaped peripheral wall 33 which is joined at the bottom by a right cylindrical part, the lower cross-section of which is congruent with the adjoining upper cross-section of the cylindrical part of the chimney tube 32. In the region of the largest upper cross-section 39, the chimney tube 32 opens into the surrounding atmosphere 40.

Figure 1:
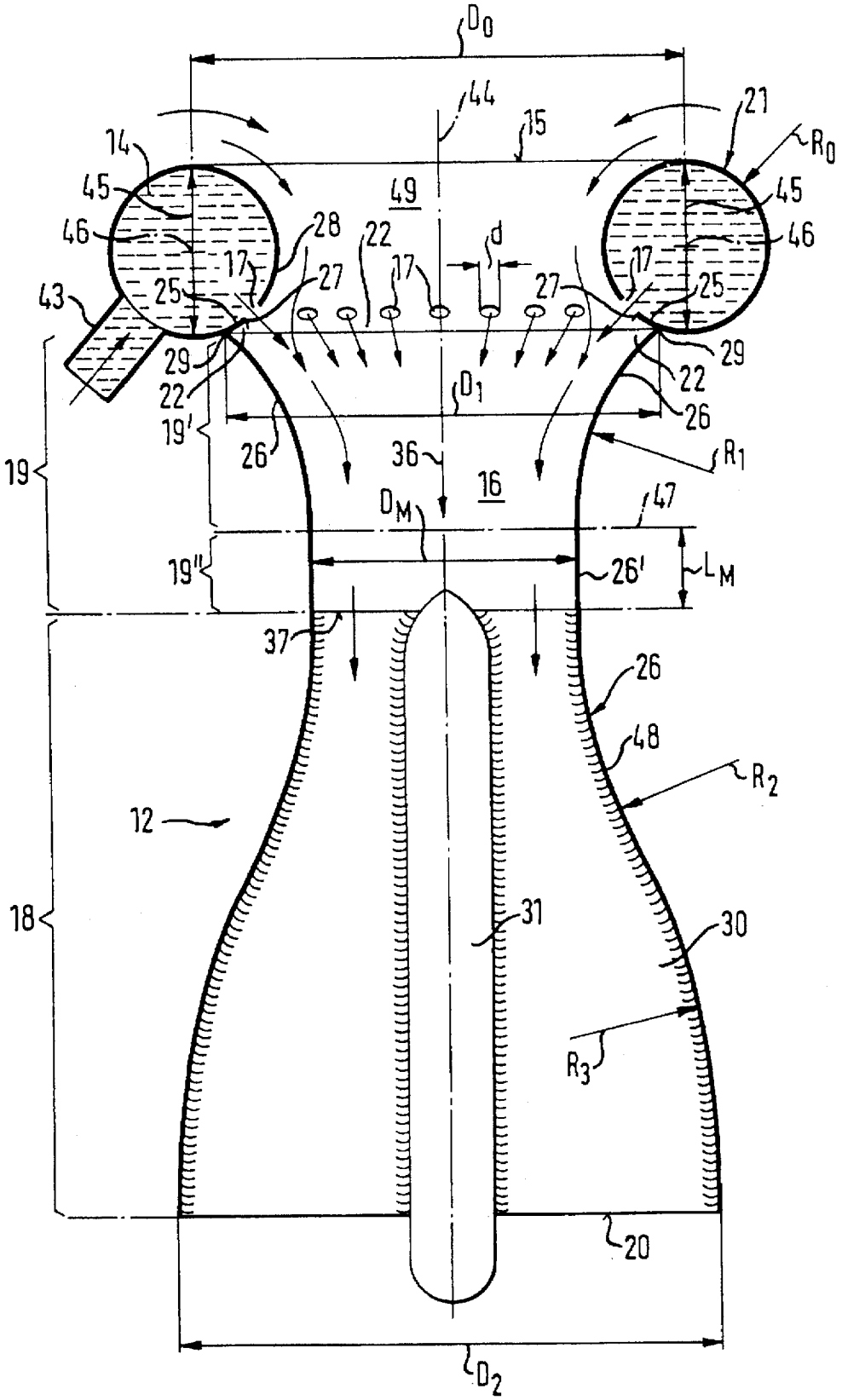
FIG. 1 is a schematic axial sectional view through a first embodiment of an injector in accordance with the invention.

Injectors 12 in accordance with the invention, such as are described in detail in the following with reference to FIGS. 1 to 8, are arranged along the periphery of the peripheral wall 33 at uniform peripheral spacings in two horizontal planes 41, 42 which lie spaced apart above one another.

The injectors 12 are charged with driving vapor through tube ducts 43 which, for example, has a pressure of 9 bars and a temperature of 450° C. In this way the injectors suck in environmental air in the direction of the curved arrows in FIG. 9 and blow the environmental air perpendicular to the peripheral wall 33 into the interior of the chimney tube 32, where it crosses with the torch gas 38. The combustible mixture of torch gas and combustion air supplied by the injectors 12 can thus be ignited by a non-illustrated ignition device and the torch gas can be burned off or flared off into the atmosphere 40 in the desired manner through the cross-section of the outlet surface 39.

The interior of the conically broadening peripheral wall 33 thus represents a combustion space 13 from the lowest plane 44 onwards at which combustion air is supplied.

In the following figures the same reference numerals designate corresponding components to those in FIG. 9.

In accordance with FIG. 1 a first embodiment of an injector 12 includes a circular ring tube 21 with a circular cross-section and an interior space 49 which is mounted onto the upper circular ring shaped inlet end face 29 of the wall 26 of a flow channel 16 and is secured there, for example, by welding. The ring-like inlet end face 29 is located somewhat radially within the diameter 45 of the circular cross-section of the ring tube 21 which extends parallel to the central axis 44 of the injector 12. Injection or blow-in openings 17 are provided in the ring tube 21 around the central axis 44 at an angle of 45° to the diameter 45 related to the circular central axis 46 of the ring tube 21 and driving vapour supplied through the conduit or pipe 43 can be introduced through the injection openings 17 into the flow channel 16 in the direction of the arrows shown in the blow-in openings 17.

Starting from the input end face 29 the flow channel wall 26 first tapers in nozzle-like manner until finally the generatrices of the wall extend parallel to the central axis 44 in the cross-sectional plane 47, with the central axis 44 simultaneously corresponding to the main flow direction 26 as indicated by an arrow. Thus a region with a right cylindrical wall 26' concentric to the central axis 44 is formed. The wall 26' extends further in the main flow direction 36 up to a terminal end face 37 onto which a diffusor 48 is mounted.

The part which tapers in the manner of a nozzle could also be formed as a truncated cone which is followed by the wall 26'. In just the same way, the diffusor region could also be formed in the manner of a truncated cone, i.e. with straight line generatrices.

In this manner, a mixing region 19 which consists of a convexly convergent region 19' and a region 19" having a wall 26' parallel to the central axis 44 and a diffusor region 18 follows the ring tube 21 concentric to the central axis 44 in the main flow direction 36. With the outlet end face 20 at the front, the injector 12 is inserted into suitable bores 50 in the peripheral wall 33 of FIG. 9 and secured there. The upper horizontal plane of the ring tube 21 in FIG. 1 forms an air induction opening 15 through which environmental air is sucked in in accordance with the curved arrows in FIG. 9 after the installation in the torch burner 11.

In accordance with FIG. 1, a wall piece 25 also extends between the radially outer edge 27 of the injection openings 17 and the input end face 29 of the flow channel wall 26, with the length of this wall piece in the circumferential direction being somewhat larger than the diameter of the injection openings 17.

As a result of the described arrangement, a dead flow space 22 arises which preferably outwardly adjoins the injection openings 17, so that the driving vapor emerging from the injection openings 17 first passes into the dead space 22 and first passes from the latter into the air flow through the air induction opening 15 from the top indicated by the direction of the arrows.

Particularly important for a trouble-free transferance of the momentum of the driving vapor which enters with high speed through the inlet openings 17 is not only the dead flow space 22, but rather also the part 19" of the mixing region 19 provided with the wall 26' extending parallel to the central axis 44.

In the diffusor 48 four guide vanes 30 are arranged distributed around the periphery which extend with their planes parallel to the main flow direction 36 and can be secured radially inwardly to a streamlined body 31 arranged concentric to the central axis 44.

The initial speed of the spray jets 23 in the order of magnitude of 600 m/s sinks in the mixing region 19 to 200 m/s and amounts to ca. 70 m/s at the outlet end face 20.

Further values for the parameters shown in FIG. 1 or for their ratios are as follows:

| | |
|---|---|
| $D_o/D_M$ | 1.7 to 2.0 |
| $D_1/D_M$ | 1.2 to 1.4 |
| $D_2/D_M$ | 1.7 to 2.2 |
| $R_o/D_M$ | 0.12 to 0.25. |
| $D_M$: | 100 to 200 mm; |
| $R_o$: | 10 to 20 mm; |
| d: | 3 to 8 mm; |
| $L_M$: | 60 to 180 mm; |

Total opening angle of the diffusor region 18: 4° to 14°;
Length of the diffusor region 18: ca. 100 mm to 200 mm.

Figure 2:
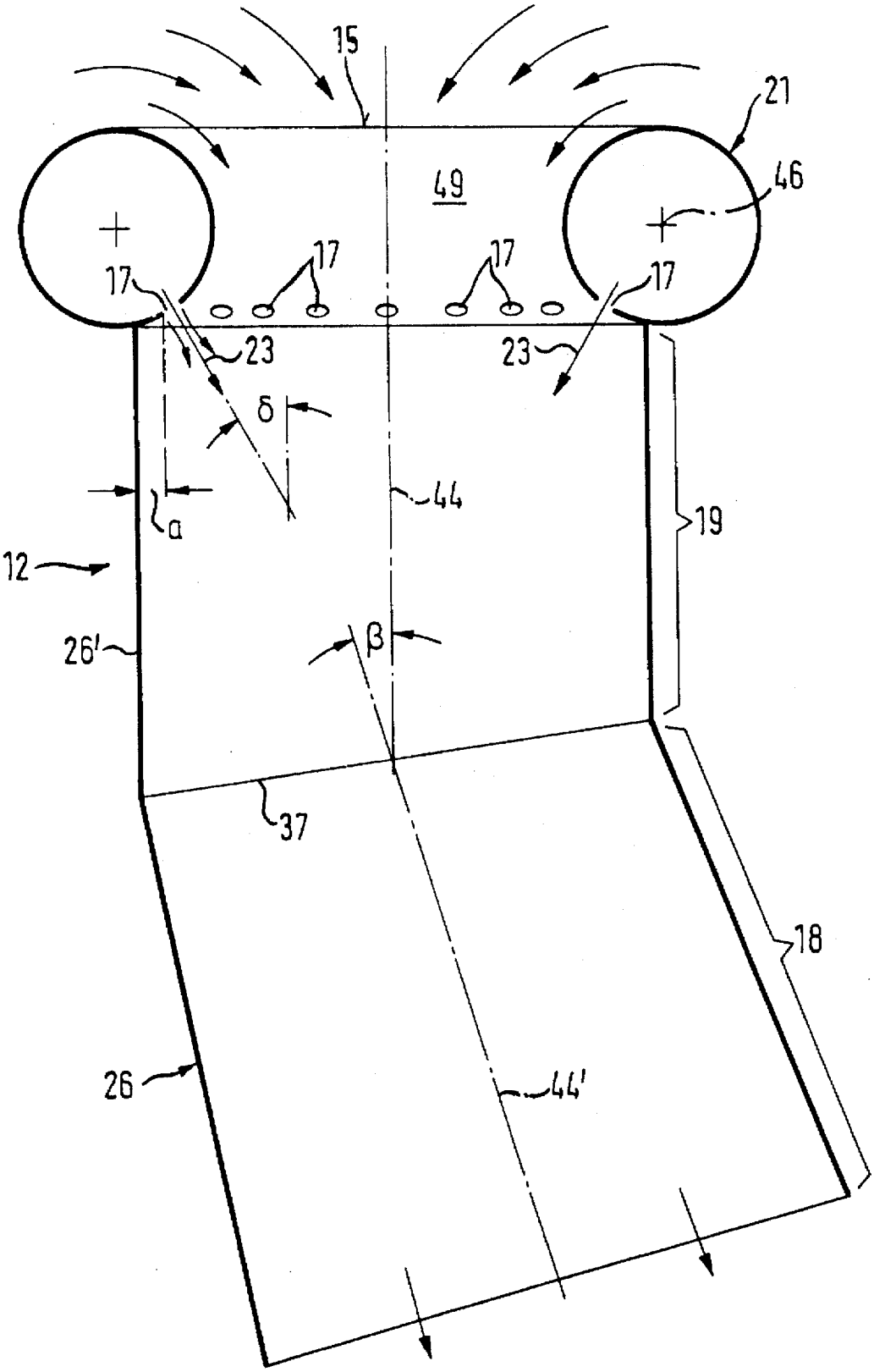
FIG. 2 is a corresponding more schematic sectional view of a further embodiment of an injector in accordance with the invention.

FIG. 2 shows an embodiment in which, in comparison with FIG. 1, a mixing range 19 is arranged, with a continuous right cylindrical wall 26' concentric to the circular ring tube 21 and the to central axis 44. In accordance with FIG. 2, the walls 26' of the preferred mixing region 19 abut approximately perpendicularly to the lower tangent to the circular cross-section of the ring tube 21.

Important in this embodiment is not only the clear spacing "a" of the injection openings 17 from the wall 26', but rather also the angle δ at which the spray jets 23 generated by the driving vapor emerging through the injection openings 17 extend relative to the central axis 44 or to the generatrix of the wall 26'. In the embodiment of FIG. 2 the angle δ is illustrated exaggeratedly large; it preferably has a size between 5° and 20°.

A further important feature of the embodiment of FIG. 2 lies in the fact that the central axis 44' of the diffusor region 18 is not aligned with the central axis 44 of the mixing region 19, but is rather angled at a small angle of 15° to 20° relative to the latter. In order to obtain the most continuous flow transition possible, the connection end face 37 of the mixing region 19 is not arranged perpendicular, but rather at the half angle δ to the central axis 44. In just the same way, the corresponding entry end face of the diffusor region 18 exhibits the half angle δ to its central axis 44'.

Figure 9:
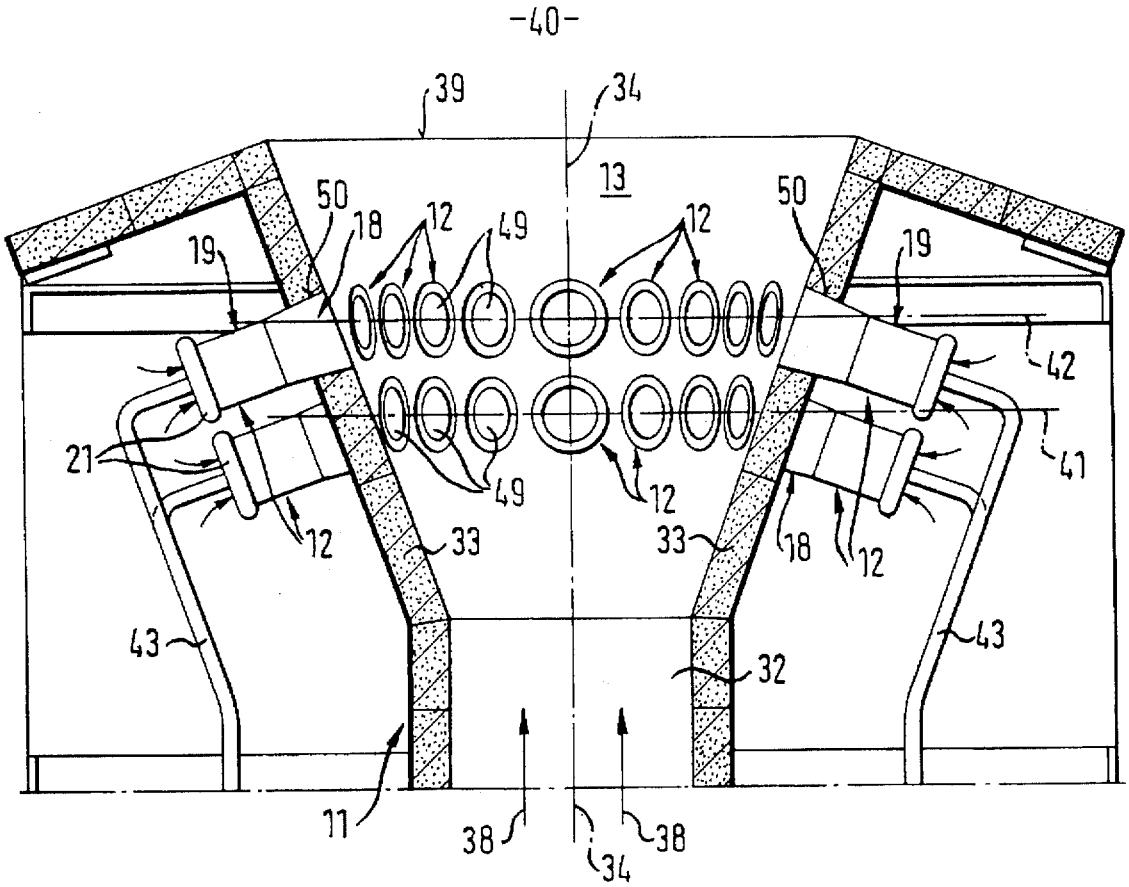
FIG. 9 is an axial section through the upper region of a torch burner at which injectors, in accordance with one of the preceding embodiments, are arranged.

The angling of the diffusor region 18 in accordance with FIG. 2 has the sense that on assembling the injector 12 to a torch burner in accordance with FIG. 9, the mixing region 19 can also then be approximately horizontally aligned when the diffusor region 18 is inserted into a conically divergent peripheral wall 33 in accordance with FIG. 9.

Figure 3:
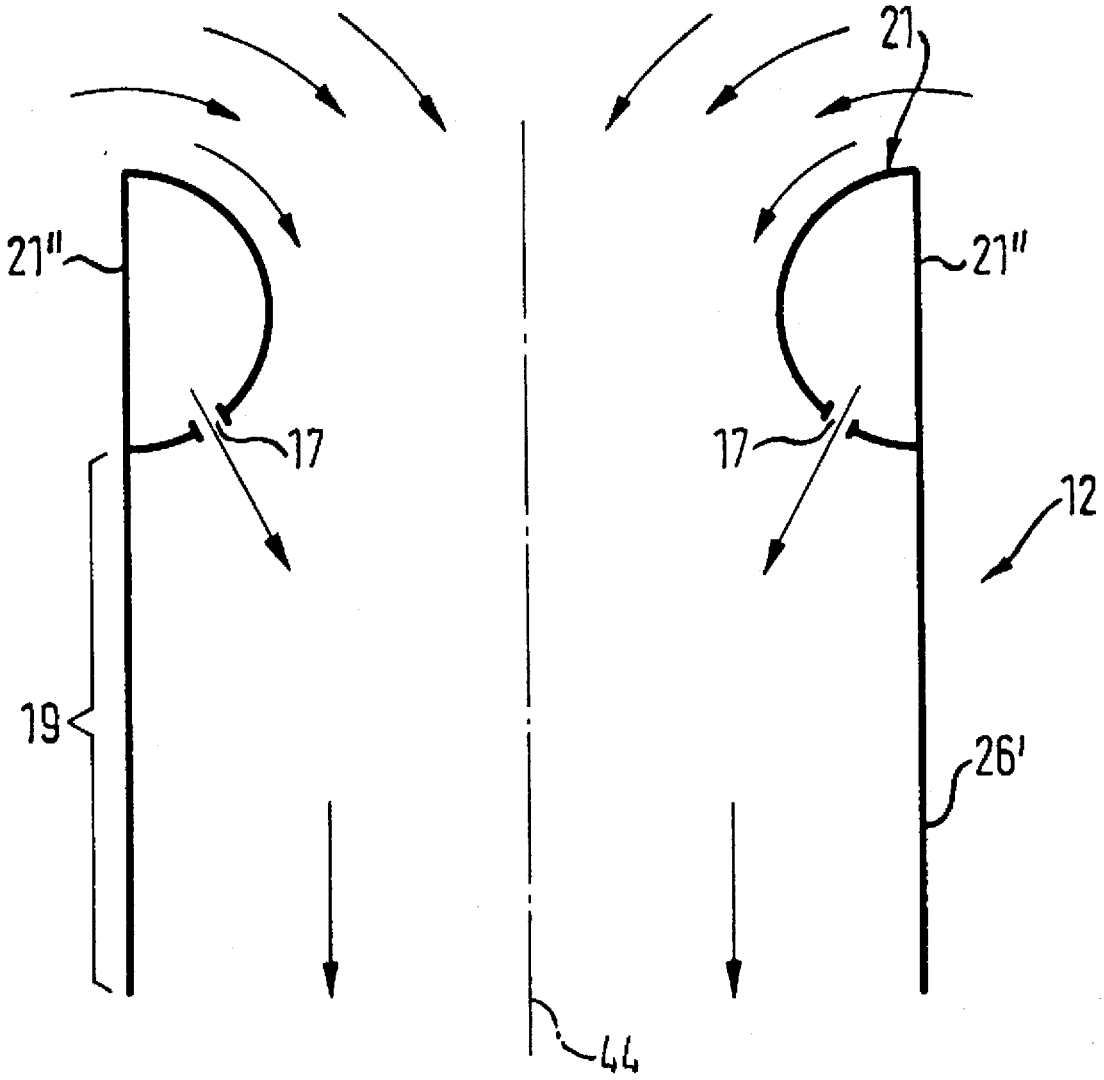
FIG. 3 is a highly schematic section through only the mixing region of a further embodiment of an injector in accordance with the invention.

FIG. 3 shows that the ring tube 21 can also have a semi-circular cross-section which is so mounted onto the wall 26' of the right cylindrical mixing region 18 extending parallel to the central axis 44 that the flat peripheral wall region 21" of the ring tube 21 is aligned with the wall 26' in the manner evident from FIG. 3. In the embodiment of FIG. 3, a radial projection of the ring tube 21 outwardly beyond the mixing region 19 is avoided.

Figure 4:
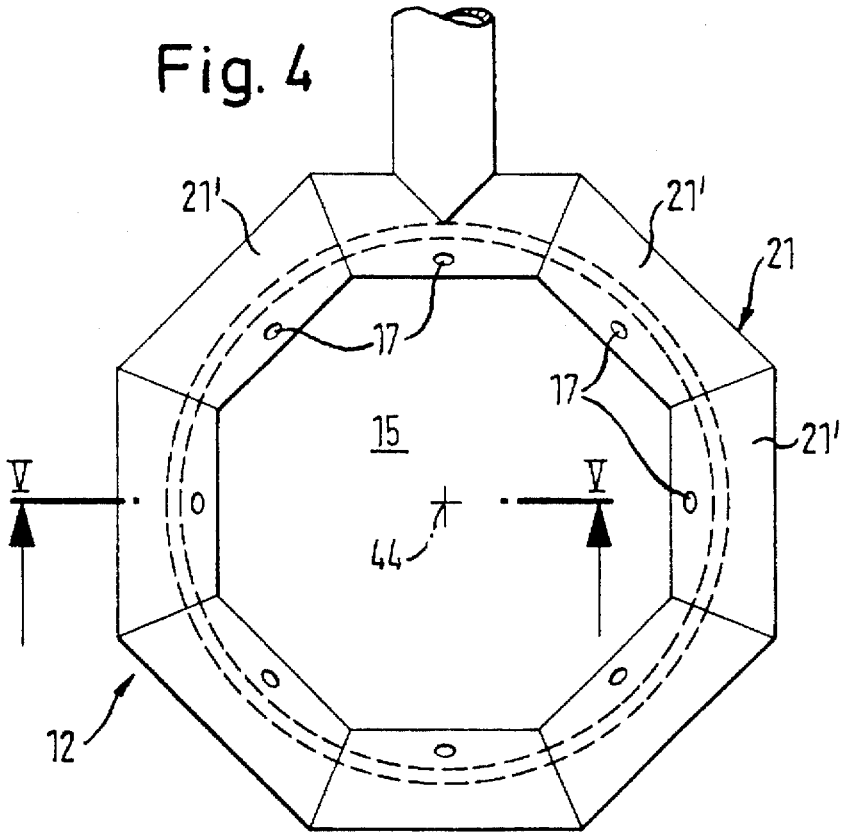
FIG. 4 is a schematic sectional view of the mixing region of a further embodiment of an injector in accordance with the invention provided with a polygonal ring tube.
Figure 5:
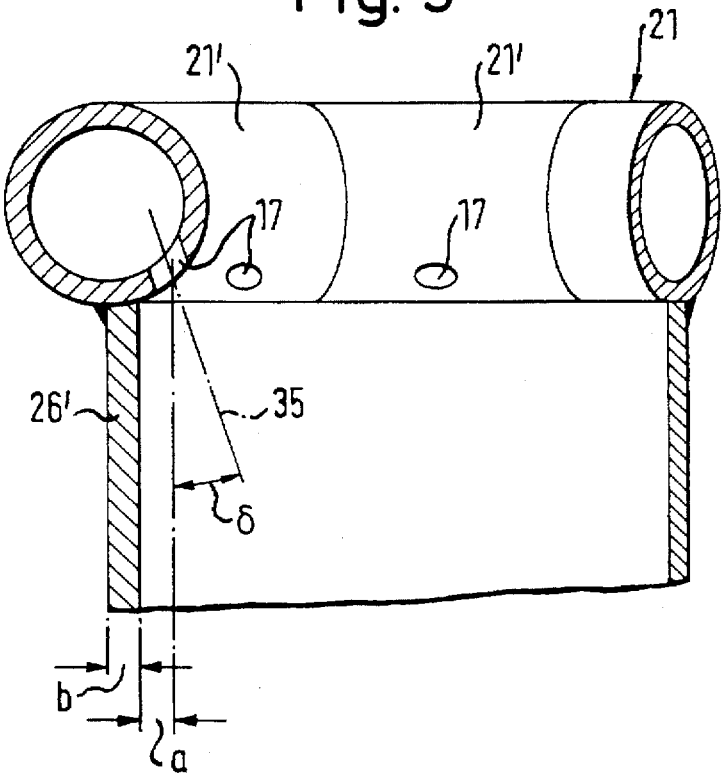
FIG. 5 is an enlarged section on the line V—V in FIG. 4.

In accordance with FIGS. 4 and 5, a ring tube 21 having a fully circular cross-section is put together into a polygonal arrangement from straight tube elements. In particular, 8 tubular elements 21' are put together into an octagonal arrangement. In the embodiments of FIGS. 4 and 5 each tube element 21' has an injection opening 17 only at the center.

The angle δ of this embodiment to the wall 26' or to the central axis 44 also lies between 5° and 20° in the embodiment of FIG. 5. The distance "a" of the central axis of the injection opening 17 from the wall 26' corresponds to the thickness "b" of the wall 26'.

Figure 6:
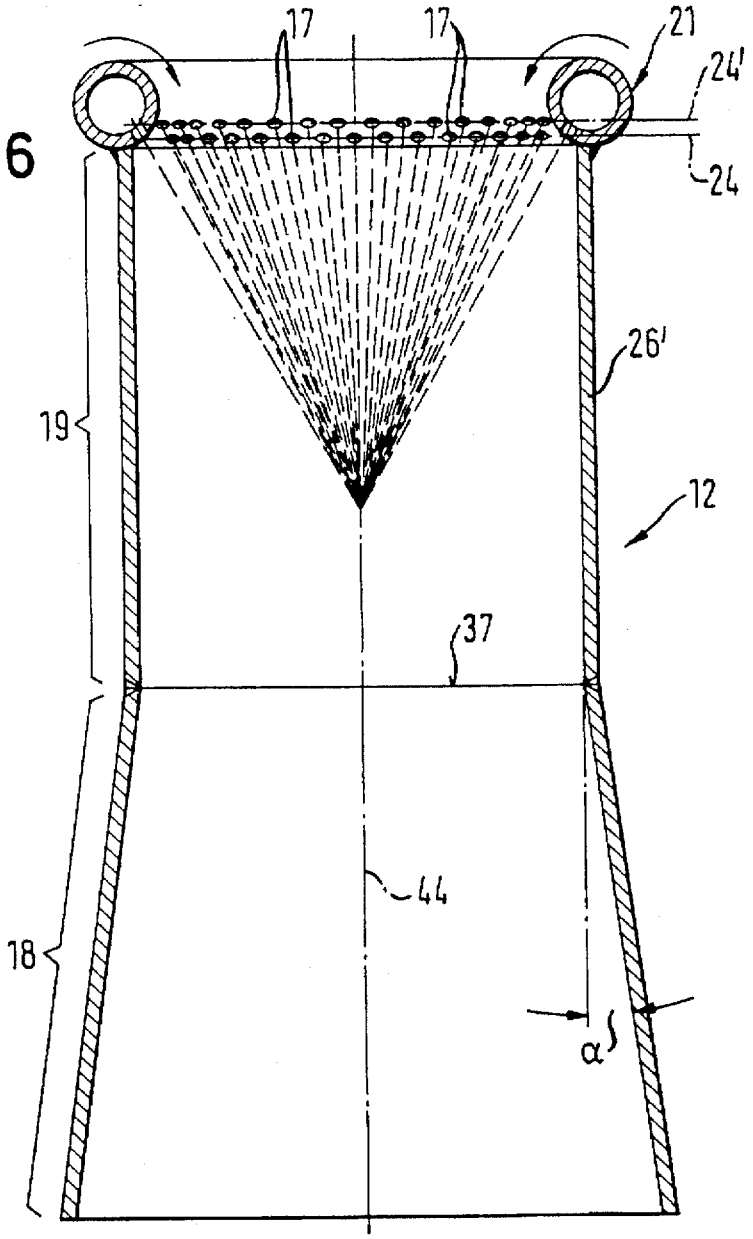
FIG. 6 is an axial section of a further embodiment of an injector in accordance with the invention with two ring arrangements of injection openings.
Figure 7:
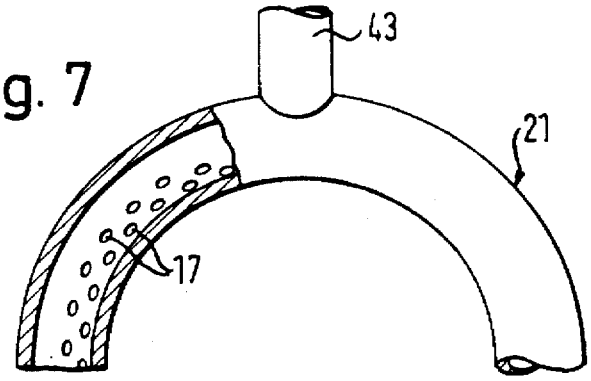
FIG. 7 is a partial plan view of the subject of FIG. 6 with the ring tube partly broken away.

In the embodiment of FIGS. 6 and 7, the ring tube 21 of circular cross-section, the mixing region 19 and the diffusor region 18 have the same central axis 44. In contrast to the previously described embodiments, two ring arrangements of injections openings 17 are, however, provided here in the lower inner quadrants of the circular ring tube 21. The injection openings 17 are namely provided in planes 24, 24' which lie axially above one another, which extend perpendicular to the central axis 44, and which thus define spray jets which emerge into the mixing region at different angles to the central axis 44.

The axes of the injection openings 17 can extend in the simplest case perpendicular to the tangents to the cross-section of the ring tube 21 at the position where the relevant opening is located. It is, however, preferred when these axes are inclined somewhat in the direction of the wall 26 in such a way that the spray jets 23 have a smaller angle to the central axis 44 than with perpendicular emergence. The relevant angle must, however, remain different from zero.

Figure 8:
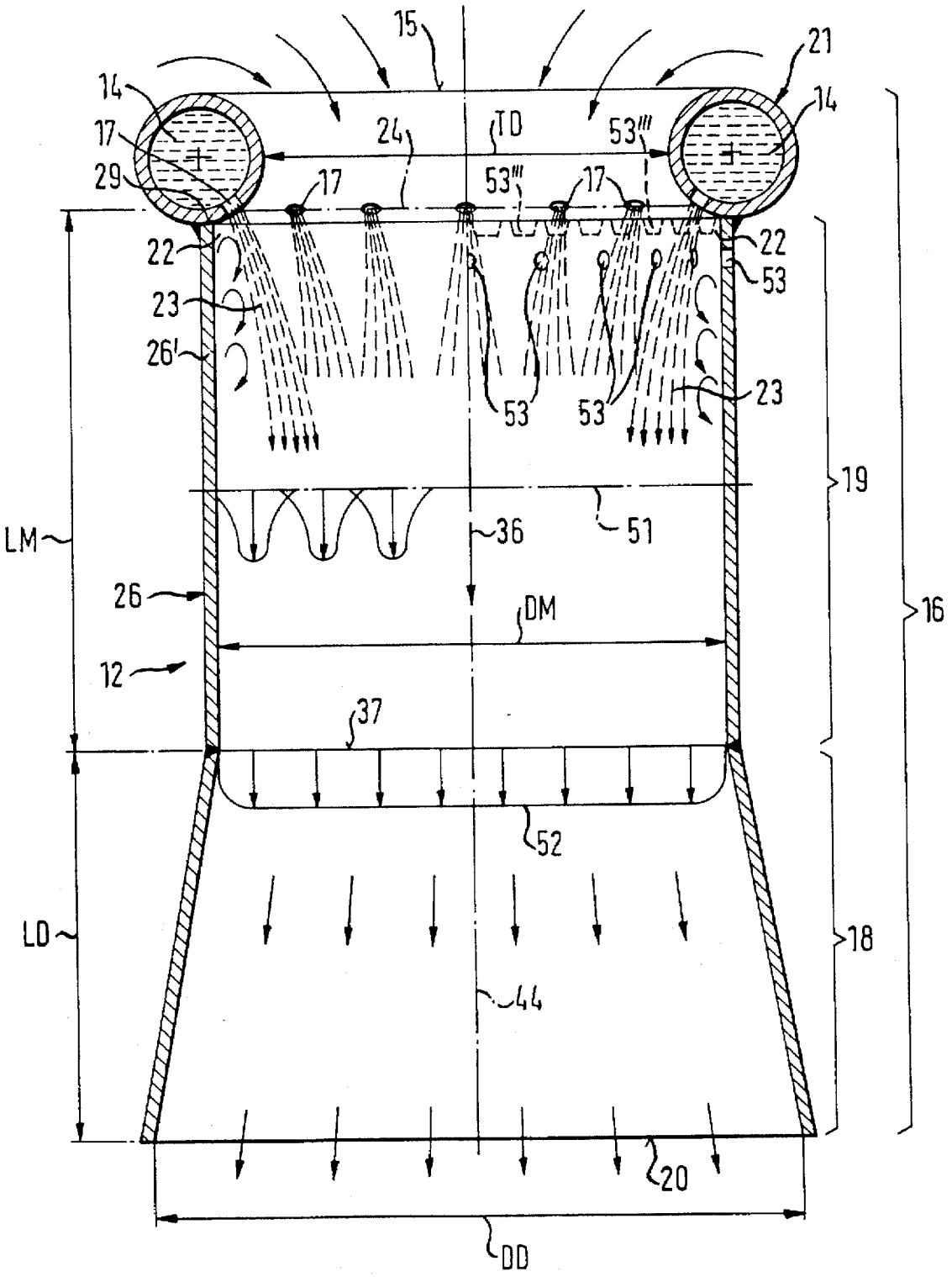
FIG. 8 is a sectional view of a further embodiment to explain the action of the injector of the invention, with different versions being shown to the left and right of the central axis.

To the right of the central axis 44 in FIG. 8 there is shown a further embodiment in which bores 53 leading to the outer atmosphere are provided directly beneath the ring tube 21 in the right cylindrical wall and are uniformly distributed around the entire periphery.

In place of these bores, cutouts 53', 53" and 53'" can also be provided in accordance with FIG. 8 in the upper end face 29 of the flow channel wall 26 which are either approximately semi-circular in radial view as seen in FIG. 8*a*, or triangular in FIG. 8*b*, or trapezoidal in FIGS. 8 and 8*c*.

The manner of operation of the injector 12 of the invention will be described in the following with reference to FIG. 8.

In accordance with FIG. 8, the driving vapor which, for example, flows through 13 to 16 injection openings 17 with a speed of for example 600 m/s forms spray jets 23 which first enter into the dead flow space 22 provided in accordance with the invention and pass out of the latter into the actual mixing region 19. As a result of the clear spacing of the injection openings 17 from the peripheral wall 26' of the mixing region 19, a slight return flow prevails in the wall region because the static pressure of the total flow in the main flow direction 36 rises along the mixing region 19 towards the diffusor region 18. By high turbulent friction with large differential speeds, a first effective through-mixing of the driving vapor and air takes place here, and indeed not only at the side of the spray jets 23 directed to the wall, but rather also at the side of the spray jets facing towards the central axis 44.

Thus extremely rapid vapor jets are quickly mixed with the induced air. The air is accelerated to a higher speed in the direction of the main flow and the spray or driving jets 23 are correspondingly retarded as a consequence of the interaction. The retardation by the momentum transfer from the spray jets to the air takes place in the comparatively short mixing path 19.

With the arrangement of the additional air induction openings 53, 53', 53", and/or 53'" in accordance with the illustration to the right of the central axis 44 in FIG. 8 (where one embodiment of the additional air induction openings 53 is shown in full lines and a further embodiment 53' is shown in broken lines), or in FIGS. 8*a*, 8*b* and 8*c*, additional outer air is sucked in which is mixed with the air/driving vapor mixture flowing back in the flow channel 16 and increases the total air throughput.

In the plane 51, the velocity profile is schematically indicated and is not yet fully balanced there. At the connection end face 37 for the diffusor region 18, a largely smoothed out velocity profile 52 is however already present over the entire cross-section of the flow channel 16. In the diffusor region 13 the speed of the air flow mixed with the driving vapour is then only reduced to a value such as is desired for the injection into the combustion chamber 13 of FIG. 9.

Preferred dimensions of the individual components are as follows with reference to FIG. 8:

Internal diameter ID of the ring tube 21: 115 mm

Length LM of the mixing region 19: 150 mm

Length LD of the diffusor region 18: 150 mm

Diameter DM of the mixing region: 130 mm

Diameter DD of the outlet end face 20 of the diffusor region 18: 160 mm.

All components of the injector 12 with the exception of the angled diffusor region 18 of FIG. 2 are arranged concentric to the central axis. The ring tube 21 can be circular or polygonal.

What is claimed is:

1. In combination with a torch burner having an inlet, an outlet, and a combustion chamber between the inlet and the outlet having a wall between the inlet and the outlet, and a series of injectors for receiving driving fluid and ambient air from exterior of the combustion chamber and discharging intermixed ambient air and driving fluid interior of the combustion chamber, the improvement to the injectors comprising in combination:

an air induction opening outside of the combustion chamber for receiving ambient air;

an air flow channel from the air induction opening for receiving ambient air and discharging through the wall of the combustion chamber into the combustion chamber;

the air flow channel having a driving fluid mixing region, and a diffuser region for discharge into the combustion chamber;

the driving fluid mixing region defining a constricting passage from the air induction opening to and toward the driving fluid mixing region;

a driving fluid manifold constituting a ring tube having at least a semi-circular cross-section, the ring tube being mounted to the air induction opening within the driving fluid mixing region, the driving fluid manifold having an inlet for receiving the driving fluid, and a plurality of outlets;

the plurality of outlets discharging to the driving fluid mixing region with a velocity component for moving the intermixed ambient air, and driving fluid from the air induction opening through the diffuser region for discharge to the combustion chamber;

the plurality of outlets provided on the ring tube toward the driving fluid mixing region following a narrowest cross-section of the ring tube;

each of the outlets of the plurality of outlets is spaced from the flow channel wall a distance larger than an opening of the outlets; and the driving fluid manifold defining a dead flow space between the air induction opening and the driving fluid mixing region, with the plurality of outlets directed from the dead flow space into the mixing region.

2. The improvement to the air injectors as set forth in claim 1, wherein:

the diffuser region of the air flow channel expands from the driving fluid mixing region to the outlet of the air flow channel, the wall diverging at an angle 5° to 20° to the driving fluid from the plurality of outlets.

3. The improvement to the air injectors as set forth in claim 1 wherein:

the diffuser region of the air flow channel expands from the driving fluid mixing region to the outlet of the air flow channel, the wall diverging at an angle 5° to 20° to the driving fluid from the plurality of outlets.

4. The improvement to the air injectors as set forth in claim 1 wherein:

the driving fluid manifold constituting a ring tube has at least four sections which form a polygonal configuration.

5. The improvement to the air injectors as set forth in claim 1 wherein:

the plurality of outlets discharging to the driving fluid mixing region are cylindrical bores in the ring tube.

6. The improvement to the air injectors as set forth in claim 1 wherein:

the driving fluid mixing region defines at the intersection of the driving fluid mixing region and the ring tube an angle of 40° to 90°.

7. The improvement to the air injectors as set forth in claim 1 wherein:

the ratio of the diameter of air induction opening at the ring tube and the smallest diameter of the mixing region is in the range of 1.25 to 2.5.

8. The improvement to the air injectors as set forth in claim 1 wherein:

the ratio of the diameter of the mixing region at the inlet from the driving fluid mixing region and a smallest diameter of the mixing region is in the range of 1.1 to 2.0.

9. The improvement to the air injectors as set forth in claim 1 wherein:

the ratio of the largest diameter of the diffuser region to the smallest diameter of the driving fluid mixing region is in the range of 1.5 to 2.7.

10. The improvement to the air injectors as set forth in claim 1 wherein:

the ratio of the cross-sectional radius of the ring tube to the smallest diameter of the mixing region is in the range of 0.15 to 0.45.

11. The improvement to the air injectors as set forth in claim 1 wherein:

the driving fluid mixing region has a constant diameter.

12. The improvement to the air injectors as set forth in claim 1 wherein:

the angle between generatrices of walls of the mixing region and axes of the plurality of outlets is in the range of 5° to 20°.

13. The improvement to the air injectors as set forth in claim 1 wherein:

the diffuser region is joined to the driving fluid mixing region at an angle.

14. The improvement to the air injectors as set forth in claim 1 wherein:

air induction openings are defined in the driving fluid mixing region for admitting ambient air.

15. The combination of claim 1 and wherein the injectors are distributed around respective horizontal planes.

16. The combination of claim 15 and wherein the injectors are perpendicular to the wall of the combustion chamber, and have an inclination with respect to an axis taken through the conically divergent combustion chamber, up to a maximum angle of 30°.

17. In combination with a torch burner having an inlet, an outlet, and a combustion chamber between the inlet and the outlet having a wall between the inlet and the outlet, and a series of injectors for receiving driving fluid and ambient air from exterior of the combustion chamber and discharging intermixed ambient air and driving fluid interior of the combustion chamber, the improvement to the injectors comprising in combination:

an air induction opening outside of the combustion chamber for receiving ambient air;

an air flow channel from the air induction opening for receiving ambient air and discharging through the wall of the combustion chamber into the combustion chamber;

the air flow channel having a driving fluid mixing region, and a diffuser region for discharge into the combustion chamber;

the diffuser region is subdivided by a plurality of sheet metal vanes;

the driving fluid mixing region defining a constricting passage from the air induction opening to and toward the driving fluid mixing region;

a driving fluid manifold constituting a ring tube having at least a semi circular cross-section, the ring tube being mounted to the air induction opening within the driving fluid mixing region, the driving fluid manifold having an inlet for receiving the driving fluid, and a plurality of outlets;

the plurality of outlets discharging to the driving fluid mixing region with a velocity component for moving the intermixed ambient air, and driving fluid from the air induction opening through the diffuser region for discharge to the combustion chamber;

the plurality of outlets provided on the ring tube toward the driving fluid mixing region following a narrowest cross-section of the ring tube; and the driving fluid manifold defining a dead flow space between the air induction opening and the driving fluid mixing region, with the plurality of outlets directed from the dead flow space into the mixing region.

18. In combination with a torch burner having an inlet, an outlet, and a combustion chamber between the inlet and the outlet having a wall between the inlet and the outlet, and a series of injectors for receiving driving fluid and ambient air from exterior of the combustion chamber and discharging intermixed ambient air and driving fluid interior of the combustion chamber, the improvement to the injectors comprising in combination:

an air induction opening outside of the combustion chamber for receiving ambient air;

an air flow channel from the air induction opening for receiving ambient air and discharging through the wall of the combustion chamber into the combustion chamber;

the air flow channel having a driving fluid mixing region, and a diffuser region for discharge into the combustion chamber;

the diffuser region has a streamlined body centrally mounted in the diffuser;

the driving fluid mixing region defining a constricting passage from the air induction opening to and toward the driving fluid mixing region;

a driving fluid manifold constituting a ring tube having a circular cross-section, the ring tube being mounted to the air induction opening within the driving fluid mixing region, the driving fluid manifold having an inlet for receiving the driving fluid, and a plurality of outlets;

the plurality of outlets discharging to the driving fluid mixing region with a velocity component for moving the intermixed ambient air, and driving fluid from the air induction opening through the diffuser region for discharge to the combustion chamber;

the plurality of outlets provided on the ring tube toward the driving fluid mixing region following a narrowest cross-section of the ring tube; and the driving fluid manifold defining a dead flow space between the air induction opening and the driving fluid mixing region, with the plurality of outlets directed from the dead flow space into the mixing region.

* * * * *